US005272337A

United States Patent [19]

Thompson et al.

[11] Patent Number: 5,272,337

[45] Date of Patent: Dec. 21, 1993

[54] SAMPLE INTRODUCING APPARATUS AND SAMPLE MODULES FOR MASS SPECTROMETER

[75] Inventors: Cyril V. Thompson, Knoxville; Marcus B. Wise, Kingston, both of Tenn.

[73] Assignee: Martin Marietta Energy Systems, Inc., Oak Ridge, Tenn.

[21] Appl. No.: 865,164

[22] Filed: Apr. 8, 1992

[51] Int. Cl.[5] ..... H01J 49/04

[52] U.S. Cl. ..... 250/288

[58] Field of Search ..... 250/288, 288 A; 422/88; 436/32; 73/864, 82, 864.85, 19.1

[56] References Cited

U.S. PATENT DOCUMENTS

| | | | |
|---|---|---|---|
| RE. 33,344 | 9/1990 | Stafford . | |
| Re. 34,000 | 7/1992 | Syka et al. . | |
| 3,583,347 | 6/1971 | Moshonas | 250/288 |
| 3,800,595 | 4/1974 | Vincent | 73/19.1 |
| 3,920,986 | 11/1975 | Fies, Jr. . | |
| 4,055,987 | 11/1977 | McFadden . | |
| 4,075,479 | 2/1978 | Reeher et al. . | |
| 4,214,160 | 7/1980 | Fies et al. . | |
| 4,376,391 | 3/1983 | Brunnee . | |
| 4,405,860 | 9/1983 | Brunnee et al. . | |
| 4,423,324 | 12/1983 | Stafford . | |
| 4,495,413 | 1/1985 | Lerche et al. . | |
| 4,535,235 | 8/1985 | McIver, Jr. . | |
| 4,536,652 | 8/1985 | Cooks et al. . | |
| 4,540,884 | 9/1985 | Stafford et al. . | |
| 4,736,101 | 4/1988 | Syka et al. . | |
| 4,736,105 | 4/1988 | Fonnesbeck . | |
| 4,755,670 | 7/1988 | Syka et al. . | |
| 4,766,314 | 8/1988 | Jung . | |
| 4,771,172 | 9/1988 | Weber-Grabau et al. . | |
| 4,808,818 | 2/1989 | Jung . | |
| 4,816,675 | 3/1989 | Fies et al. . | |
| 4,818,869 | 4/1989 | Weber-Grabau . | |
| 4,882,485 | 11/1989 | Duryea | 250/288 |
| 4,985,625 | 1/1991 | Hurst . | |
| 5,026,987 | 6/1991 | Bier et al. . | |
| 5,043,575 | 8/1991 | Habfast et al. . | |
| 5,062,242 | 11/1991 | Kanba et al. | 73/19.1 |
| 5,072,115 | 12/1991 | Zhou . | |
| 5,075,547 | 12/1991 | Johnson et al. . | |
| 5,089,703 | 2/1992 | Schoen et al. . | |
| 5,107,109 | 4/1992 | Stafford et al. . | |
| 5,118,937 | 6/1992 | Hillenkamp et al. . | |
| 5,128,542 | 7/1992 | Yates et al. . | |

FOREIGN PATENT DOCUMENTS

WO90/15658 6/1990 PCT Int'l Appl. .

OTHER PUBLICATIONS

"Ion Trap Detector Operation Manual" Finnigan MAT Corp. San Jose Calif. 95134-1991 (1987) FIG. 2 pp. 7, 8, 1-12 and 1-13.

*Primary Examiner*—Jack I. Berman

*Attorney, Agent, or Firm*—Earl L. Larcher; Harold W. Adams

[57] ABSTRACT

An apparatus for introducing gaseous samples from a wide range of environmental matrices into a mass spectrometer for analysis of the samples is described. Several sample preparing modules including a real-time air monitoring module, a soil/liquid purge module, and a thermal desorption module are individually and rapidly attachable to the sample introducing apparatus for supplying gaseous samples to the mass spectrometer. The sample-introducing apparatus uses a capillary column for conveying the gaseous samples into the mass spectrometer and is provided with an open/split interface in communication with the capillary and a sample archiving port through which at least about 90 percent of the gaseous sample in a mixture with an inert gas that was introduced into the sample introducing apparatus is separated from a minor portion of the mixture entering the capillary discharged from the sample introducing apparatus.

27 Claims, 4 Drawing Sheets

SAMPLE INTRODUCING APPARATUS AND SAMPLE MODULES FOR MASS SPECTROMETER

This invention was made with the support of the U.S. Government under contract No. DE-AC05-84OR21 400 awarded by the U.S. Department of Energy. The U.S. Government has certain rights in this invention.

BACKGROUND OF THE INVENTION

The present invention relates to a sample introducing interface system defined by a sample introducing apparatus and sample modules connectable therewith for direct analysis and measurement of volatile and partially volatile organics or organic compounds obtainable from various environmental matrices in mass spectrometers.

The analysis and measurement of trace levels of volatile and partially volatile organics and organic compounds in environmental matrices such as air, water, and soil has been achieved by employing direct sampling mass spectrometry. Such monitoring of environmental matrices is becoming of increasing interest due to environmental pollution concerns. In direct sampling mass spectrometry, a sample of the organic or organic compound in gaseous form is directly inserted into the high vacuum region of the mass spectrometer without first undergoing sample preparation such as provided by the use of gas chromatography or other sample separating procedures. By directly introducing a sample into the high vacuum region of the mass spectrometer, the response time for the analysis of the sample is substantially instantaneous with the analysis providing an accurate quantification of target analytes. In direct sampling mass spectrometry, the individual organics or organic compounds are analyzed by using one or more techniques such as spectra subtraction, selective chemical ionization, and tandem mass spectrometry.

Mass spectrometers useful in the practice of direct sampling mass spectrometry are presently commercially available and include ion trap mass spectrometers such as provided by Finnigan MAT Corporation, San Jose, Calif., 95134-1991. Ion trap mass spectrometers are provided with vacuum chambers which are pumped to high vacuum with one or more turbomolecular pumps. The vacuum chamber and the analyzer cell within the mass spectrometer are preferably maintained at a constant temperature of about 120° C. to help minimize the absorption of contaminants on exposed surfaces in the mass spectrometer. The ion trap mass spectrometers are preferably equipped with the necessary hardware and software for performing electron impact, chemical ionization, selective ion ejection, and collision induced dissociation multiple-step mass spectrometry experiments.

Another type of mass spectrometer which can be utilized for the direct sampling of volatile organics or organic compounds is provided by a tandem source quadrupole mass spectrometer. This type of spectrometer performs electron input measurements and can include a glow discharge ionization source. Ions generated by glow discharge ionization are passed through a lens assembly into the high vacuum region of the mass spectrometer where they enter the lens assembly of the electron impact source and are subsequently focused into the mass analyzer.

The introduction of samples of volatile and partially volatile organics and organic compounds into high vacuum regions of mass spectrometers such as generally described above has been achieved by utilizing a transfer interface attached to a standard gas chromatograph or other sample preparing mechanism. The transfer interface conveys the prepared gaseous sample into the high vacuum region of the mass spectrometer by using a capillary column which, at least partially, extends between the gas chromatograph or other sample preparing mechanism to the high vacuum chamber of the mass spectrometer. The capillary column is supported in a tube assembly that is fixedly attached to the mass spectrometer and to the gas chromatograph or other sample preparing mechanism. The tube assembly is maintained under vacuum and is provided with a heating arrangement for heating the capillary to a sufficient temperature to prevent adsorption of volatiles on inner surface regions thereof. While such a transfer interface provide for the transfer of the sample to the mass spectrometer from a gas chromatograph or other sample preparing mechanism, the changing of the mass spectrometer from one type of sampling configuration to another type of sampling configuration requires that the mass spectrometer be shut down. Consequently, analyses of environmental samples contained in different matrices such as air, soil, and water have typically been conducted by using separate mass spectrometers that are individually dedicated to a particular sampling configuration such as for soil/water analysis, thermal decomposition analysis, or analysis of an air sample from a suitable source such as the atmosphere since there was no mechanism previously available for changing a single mass spectrometer from one type of sampling configuration to another type of sampling configuration without undergoing a time consuming operation requiring the shutting down of the mass spectrometer.

SUMMARY OF THE INVENTION

Accordingly, an object of the present invention is to provide a sample introducing interface system incorporating apparatus which provides for quickly configuring a single mass spectrometer for directly analyzing samples derived from any of soil/water matrices, air, or supported on matrices in tubular cartridges.

Another object of the present invention is to provide a sample receiving and retaining mechanism wherein a portion of the sample being introduced into the mass spectrometer may be archived for subsequent analysis.

A further object of the present invention is to provide a sample introducing apparatus wherein the response time for analyzing a sample, especially air removed from a site remote to the mass spectrometer, is significantly reduced to essentially real time and achieved by providing the sample introducing apparatus with a relatively large volume of rapidly retrieved air sample and then bleeding off a substantial portion of the retrieved sample while introducing a sufficient volume of the sample into the mass spectrometer for accurate analysis of the organics or organic compounds contained therein.

A still further object of the present invention is to provide a plurality of sample preparing modules for use with a single sample introducing apparatus with such modules including a soil/water purging module, a thermal desorption module for displacing of chemicals trapped on a sorbent bed contained in a tubular sampling cartridge, and a real-time air monitoring module which continuously draws in air and combines the air with a pulsing stream of inert gas, preferably helium, to provide about an order of magnitude increase in the sensitivity of the sample relative to the sensitivity provided by a fixed-ratio, continuous mixing non-pulsing of the helium with air.

A still further object of the present invention is to provide the sample introducing apparatus and each sample preparing module connectable therewith a rapidly actuatable coupling arrangement whereby the modules used for separate sampling configurations may be readily interfaced with the sample introducing apparatus.

Generally, the present invention relates to an interface system for introducing a sample for analysis into a mass spectrometer provided with a housing having a vacuum region therein. The interface system includes a sample introducing apparatus and a sample preparing module connectable therewith. The sample introducing apparatus comprises an open-ended elongated tubular means supportable by the housing of the mass spectrometer and provided with a first end region containable within the housing and a second end region positionable external to the housing. Sample module coupling means are supported by the second end region of the housing. An elongated capillary is contained within the tubular means with a first end segment of the capillary being in open communication with the sample module coupling means and with a second end segment of the capillary projecting from the open end of the first end region of the tubular means and in open communication with the vacuum region within the housing. First conduit means contain at least a portion of the first end segment of the capillary and have one end thereof connected to and in open communication with the sample module coupling means. Clamping means are supported by at least one of the tubular means and a second end of the first conduit means for providing therewith a substantially air-tight seal about the capillary. The sample module preparing means are adapted to be interfaced with the first conduit means through the coupling means for providing a gaseous stream containing a sample to be analyzed in the mass spectrometer with a minor portion of this gaseous stream being conveyable through the capillary for introduction into the vacuum region. Second conduit means have one end thereof extending substantially external to the tubular means and a second end thereof coupled to the first conduit means for receiving therefrom a major portion of the gaseous stream provided by the sample module means and removing the received major portion of the gaseous stream from the tubular means.

Sample absorbing means are attached to the second end of the second conduit means through coupling means for receiving and archiving a portion of the gaseous sample contained in the gaseous stream for subsequent analysis.

The sample module preparing means is selected from a soil/water purge module used for preparing samples of volatile or partially volatile organic contained in soil or a liquid such as water, a thermal desorption module for preparing for analysis a sample contained on a sorbent bed within a tubular housing, or an air sampling module for preparing for analysis of air samples in a continuous real-time manner. Each of these modules is adapted to be separately interfaced with the first conduit means of the above described interface system through the coupling means thereof.

Other and further objects of the present invention will become obvious upon an understanding of the illustrative embodiments about to be described or will be indicated in the appended claims, and various advantages not referred to herein will occur to one skilled in the art upon employment of the invention in practice.

Preferred embodiments of the invention have been chosen for the purpose of illustration and description. The preferred embodiments illustrated are not intended to be exhaustive nor to limit the invention to the precise forms shown. The preferred embodiments are chosen and described in order to best explain the principles of the invention and their application and practical use to thereby enable other skilled in the art to best utilize the invention in various embodiments and modifications as are best adapted to the particular use contemplated.

DETAILED DESCRIPTION OF THE INVENTION

As generally described above, the present invention is directed to a sample introducing apparatus interfaced with the high vacuum region of a suitable mass spectrometer such as described above and to individual sample preparing modules readily attachable to the sample introducing apparatus for directly providing gaseous samples into the high vacuum region of the mass spectrometer for effecting the direct analysis and measurement of the sample.

Figure 1:
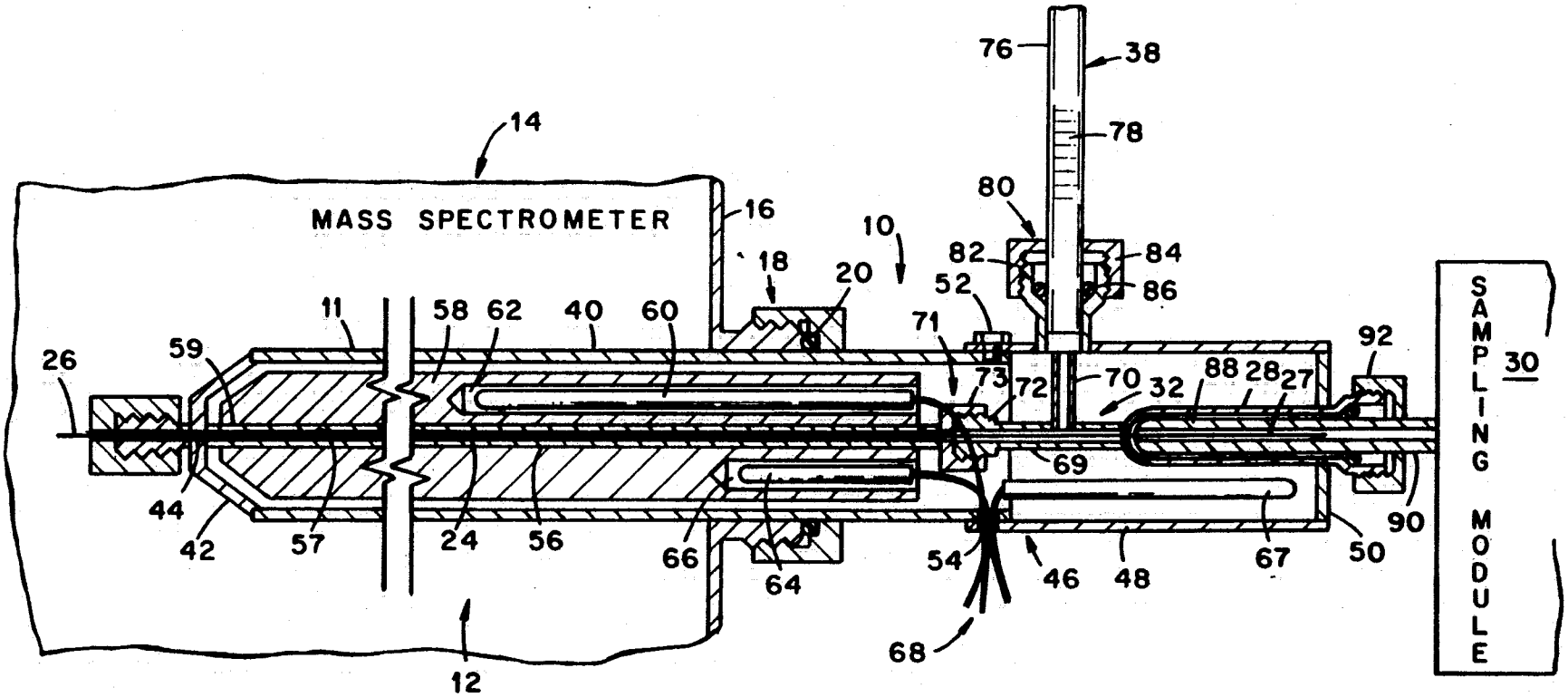
FIG. 1 is a sectional elevational view of the present invention illustrating the interface system defined by a sample introducing apparatus interfaced with a mass spectrometer and provided with sample archiving and coupled to a sample preparing module.

As shown in FIG. 1, the sample introducing apparatus 10 is in the form of an elongate cylindrical structure which has an end region 11 extending into the high volume chamber 12 of a mass spectrometer 14. The sample introducing apparatus 10 is attached to the housing 16 of the mass spectrometer 14 by a suitable mounting mechanism such as provided by a threaded compression fitting 18 using an O-ring 20 for providing an air-tight seal about the sample introducing apparatus 10. With the sample introducing apparatus 10 so mounted on the housing 16 of the mass spectrometer 14, the end region 11 of the sample introducing apparatus 10 is positionable within the high vacuum chamber 12 of the mass spectrometer 14 at a location suitable for supplying a gaseous sample to appropriate analyzing systems in the mass spectrometer for an analysis of the sample thereby.

The sample introducing apparatus 10 contains a capillary column 24 formed of a suitable material such as fused silica and which extends substantially the full length of the sample introducing apparatus. One end 26 of the capillary column is in open communication with the high vacuum chamber 12 of the mass spectrometer 14 while the opposite end 27 thereof is in open communication with an elongated receptacle 28 providing a component of a connector or coupling assembly utilized to couple or interface a sample generating or preparing module generally shown at 30 with the sample introducing apparatus 10. The end 27 of the capillary column 24 is also in communication with a crossing or interconnecting conduit system 32 having a longitudinally oriented conduit segment encompassing the capillary 24 near the end 27 thereof. The capillary column 24 extends at least partially through and preferably completely through this longitudinally oriented segment of the conduit system. The conduit system 32 forms an open/split interface with the mass spectrometer 14 and an archiving mechanism 38. A region of the capillary 24 near end 27 is connected to the conduit system 32 in an air-tight manner so that only the bore through the capillary column 24 will be in open communication with the high vacuum chamber 12 of the mass spectrometer 14.

The capillary column 24 is of a length and diameter which will provide for the flow of an adequate volume of any gaseous sample for effecting an accurate analysis and measurement thereof in the mass spectrometer. This volume of flow through the capillary column is insufficient to adversely affect the high vacuum in the mass spectrometer when the module 30 is uncoupled from the sample introducing apparatus 10 so as to expose the end 27 of the capillary 24 to atmosphere. A diameter of the bore in the capillary 24 in the range of about 75 to 175 microns is adequate for providing a flow rate of a gaseous mixture of the sample and an inert gas, preferably helium as will be referred to herein as the inert gas of choice, through the capillary in the range of about 0.5 to about 1.0 mL/min which is adequate for providing a sufficient volume of a gaseous sample for analysis in the mass spectrometer. The ratio of the sample to the helium in the gaseous mixture is in the range of about 1:1 to 1:10.

The gaseous sample is mixed with helium in the sample preparing module 30. The helium bathes the analyzing components of the mass spectrometers and also acts as a buffer gas in ion trap mass spectrometers to collisionally cool ions for reducing the loss of ions from the trap and thereby improving the overall performance of the mass spectrometer. The volume of the gaseous helium-sample mixture entering the conduit system 32 defining the open/split interface from the sample preparing module 30 is considerably greater, by a factor of at least about nine, than that of the volume of the gaseous mixture flowing through the capillary 24. By allowing the module 30 to accommodate and discharge such a larger volume of the gaseous helium-sample mixture, the efficiency in the preparation of the gaseous sample by the module is greatly enhanced. Also, the supplying of a larger volume of gaseous helium-sample mixture to the open/split interface is of particular significance for real-time air monitoring purposes, since the air being monitored at a site remote to the mass spectrometer can be continuously drawn into the air sampling module and introduced into the open/split interface at a relatively large volume. With this relatively large flow of the gaseous helium-sample mixture entering the open/split interface, approximately 90 to 99.9% of the gaseous helium-sample mixture will be exhausted from the open/split interface through the archiving assembly 38 where the gaseous sample is adsorbed and retained on a suitable sorbent packing and the balance of the gas including the helium is vented to atmosphere.

The sample introducing apparatus 10 is formed of an elongated tubular shell 40 of a length of about 7 to 15 inches with a wall thickness of about 0.0625 inch and a diameter of about 0.75 to 1.5 inches. This tubular shell 40 is preferably formed stainless steel or a similar high strength metal. A tubular shell 40 of a length in the aforementioned range is sufficient to position the end 11 of the sample introducing apparatus 10 at an appropriate location within the high vacuum chamber 12 and still provide an adequate length of the apparatus 10 external to the housing 16 for facilitating the coupling with the module 30.

As shown in FIG. 1, the end wall 42 at the end region 11 of the tubular shell 40 is of a generally conical or convex shape and has a central opening 44 receiving the capillary 24. The opposite or external end of the tubular shell 40 supports a removable end cap 46 of a closed cylindrical configuration and provided with side walls 48 and an end wall 50. The end cap 46 is attached to the end of the tubular shell 40 by providing the end cap 46 with a diameter slightly greater than that of the tubular shell 40 so as to pass over the end of the latter. The end cap 46 may then be attached to the tubular shell 40 in any suitable manner such as by employing a bolting arrangement generally indicated by bolt 52. An opening through the wall of the tubular shell 40 near the open end thereof is aligned with an opening through the side walls 48 of the end cap 54 for defining a passageway 54 for wiring as will be described below.

The tubular shell 40 contains a tube of stainless steel or the like which is attached to and cantileveredly extends from the conical end wall 42 to a location near the coupling with the end cap 46. This tube 56 is in axial alignment with the opening 44 in the end wall 42 and is of a diameter of about 0.125 inch for providing a capillary-containing passageway 57 therethrough of an adequate size for supporting and shielding the capillary column 24.

An elongated heat-conducting member 58 formed of aluminum, copper, and the like is provided with a central passageway 59 of a diameter slightly larger than that of the tube 56 and has a wall thickness sufficient to substantially fill the annular volume or space between the tube 56 and inner wall surfaces of the tubular shell 40. This heat-conducting member 58 is slid over the tube 56 for confinement within the shell 40. The heat-conducting member 58 which is of a length slightly less, about 0.25 inch, than that of the tube 56 is used as heat transfer mechanism for a tube heater 60 insertable in a longitudinal bore 62 in the exposed end of the heat-conducting member 58. This tube heater 60 is used to maintain the capillary column 24 at a constant temperature in a range of about 30° to 300° C., which is adequate to assure that contaminants will not be adsorbed on the inner walls of the capillary column during the transport of the gaseous sample therethrough. A temperature sensor such as a thermocouple 64 is contained in another longitudinal bore 66 in the exposed end of the heat-conducting member 58 for monitoring the temperature of the capillary column 24. A further tube heater 67 is placed within the end cap 46 for heating the conduit system 32 forming the open/split interface and the receptacle 28 to a temperature adequate to assure that the gaseous contaminants are not adsorbed on the inner wall surfaces of the conduit system 32, the module coupling components, or the segment of the capillary 24 contained in the conduit system 32 and the receptacle 28. The wiring for the tube heaters 60 and 67 and the thermocouple 64 is generally shown at 68 with this wiring extending through the passageway 54.

The conduit system 32 defining the open/split interface is supported by the end cap 46. The conduit system 32 is of a generally T-shaped or crossing configuration and is provided by a longitudinally extending conduit segment 69 and a conduit segment 70 extending perpendicular to the segment 69. These conduit segments 69 and 70 are suitably formed of 0.125 inch stainless steel tubing having a wall thickness of about 0.049 inch. The longitudinally extending conduit segment 69 has one end thereof connected to the tubular receptacle 28 used in the coupling with the attachable sample preparation module 30 while the other end of the conduit segment 69 is provided with a compression fitting 71 defined by a threaded sleeve 72 and a nut 73. The compression fitting 71 has an internal bore of about 0.0625 inch for receiving the capillary 24 and is used to clamp the capillary 24 to the end of the conduit 69, sealing the end of the conduit segment about the capillary in an air-tight manner. A suitable compression fitting for such use is a "Swagelok" fitting available from Swagelok Company, Solon, Ohio 44139. When the compression fitting 71 is in place on the capillary 23 and the end cap 46 attached to the shell 40, the nut 73 abuts or is in close proximity to the end of the capillary supporting tube 56. The vertically oriented conduit segment 70 of the conduit system 32 is coupled at one end thereof to the conduit segment 69 at a location generally intermediate to the ends thereof while the other end of the conduit segment 70 extends through the side walls 48 of the end cap to atmosphere or to the archival assembly 38 used for capturing and archiving samples for subsequent analysis.

The use of such an archiving assembly 38 is expected to be of significant importance in mass spectrometry applications since previous systems did not have the capability for archiving a portion of the sample being analyzed for re-analysis of the sample at some future time such as in the event a need arises for the re-analysis of the original sample for verification of the original findings. A suitable archiving assembly 38 for use in the present invention is provided by using an open-ended cylinder 76 of glass, stainless steel or the like that contains one or more layers of a suitable sorbent as generally shown at 78. The open-ended cylinder 76 may be attached to the outer end of the conduit segment 70 in an air-tight manner by using a compression fitting 80 provided by a threaded sleeve 82 on the end of the conduit segment 70, a nut 84, and an O-ring 86 of a suitable high temperature polymer such as "Teflon" or "Viton" available from E. I. duPont de Nemours & Company. A suitable compression fitting for this purpose is a "Cajon Ultra-Torr Adaptor", available from Cajon Company, Macedonia, Ohio 44056.

The sample introducing apparatus 10 provides for attachment of sample modules capable of preparing gaseous specimens from different matrices for analysis in the mass spectrometer 14. The mounting or coupling arrangement for interfacing or attaching such modules, as generally illustrated at 30, to the sampling introducing apparatus 10 is satisfactorily provided by joining the receptacle 28 with an elongated probe or plug 88 supported by the module 30 and provided with a central bore 90 for the passage of the gaseous sample from the module 30 into the open/split interface. With the plug 88 in place within the receptacle 28, the module 30 is securely connected to the sample introducing apparatus 10 by employing a suitable compression fitting 92, preferably similar to the compression fitting 80, so as to provide an air-tight coupling between the module 30 and the sample introducing apparatus 10. Of course, while the sample introducing apparatus 10 is shown with the receptacle 28 and while the module 30 is shown provided with the plug 88, it will appear clear that this receptacle-plug arrangement may be reversed and still provide a satisfactory coupling system. Also, while the capillary 24 is shown extending into and nearly through the receptacle 28, it will appear clear that the capillary 24 may be terminated near entrance into the receptacle 28 or even at a location near the end of the conduit segment 69 sealed by the compression fitting 71 and still provide satisfactory transmission of the gaseous sample into the mass spectrometer 14 through the capillary column 24.

The sample modules of the present invention are readily and rapidly connected to or disconnected from the sample introducing apparatus 10 so as to provide a quick change arrangement for the sample preparing modules. Such a quick change arrangement permits a single sample introducing apparatus 10 to be quickly interfaced with any of serveral different sample preparing modules such as a real-time air sampling module, a soil/water purged sample module, a thermal desorption module, and a helium supplying module which is used to provide a stream of helium into the mass spectrometer for bathing exposed surfaces within the mass spectrometer when the mass spectrometer is running but not coupled to a sample preparing module.

Figure 2:
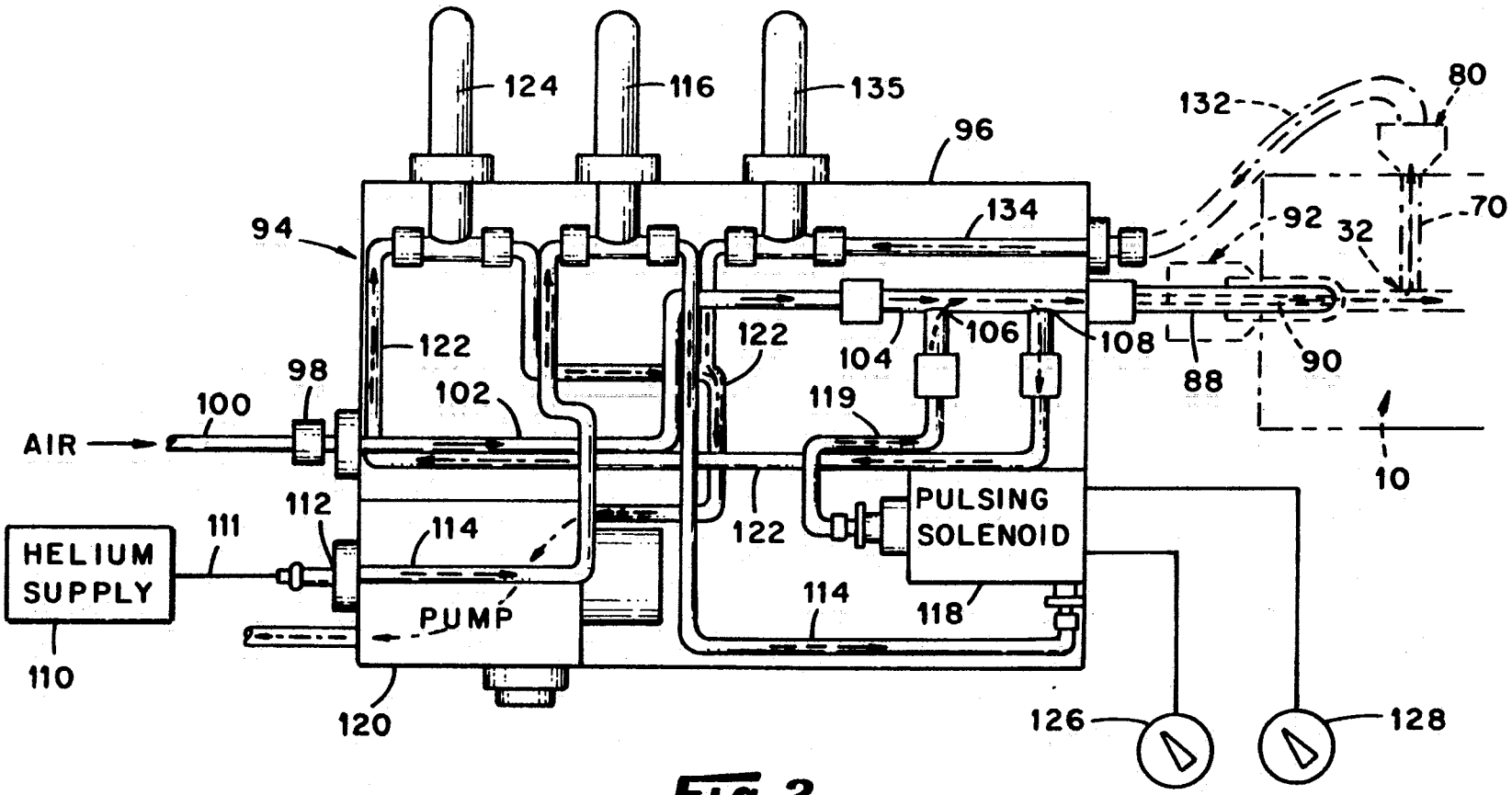
FIG. 2 is a vertical, partially sectional view illustrating an air sampling module which is readily coupled to the sample introducing apparatus of FIG. 1.

As shown in FIG. 2, a real-time air sample preparing module 94 is shown comprising a housing or casing 96 with the probe 88 cantileveredly attached to a side wall thereof. The housing is provided with an air inlet 98 which is coupled to a tubing 100 of about 0.25 inch in diameter of any suitable length which will permit the gathering of air samples from locations near or remote to the mass spectrometer for essentially real-time analysis of the air sample in the mass spectrometer 14. This is a significant aspect of the present invention since the tubing 100 regardless of its length is able to provide a continuous high volume flow of air to be sampled to module 94 in a fast moving stream so as to permit essentially real-time air monitoring. The volume of air flow is significantly reduced in the module 94 and in the open/-split interface so that the only place in the system where relatively slow movement of the air sample occurs is through the relatively short capillary column 24. An air conveying conduit 102 contained within the casing 96 is coupled to the air inlet 98 and to the passageway 90 in the plug 88 and includes a conduit segment 104 located near the plug 88 and provided with two tee sections 106 and 108.

A helium supply 110 for providing a stream of helium used in the preparation of the air sample is connected through conduit 111, helium inlet 112 on the casing 96, conduit 114 containing a flow control valve 116, to a solenoid operated valve 118 capable of pulsing the stream of helium at selected intervals for selected durations. The valve 118 provides discrete pulses of helium that are conveyed through conduit 119 and tee section 106 for mixing with the air sample. The helium is mixed with the air sample prior to the air sample being introduced into the mass spectrometer 14 to act as a buffer gas to collisionally cool ions and thereby reduce the loss of ions from the ion trap for improving the overall performance of the mass spectrometer. The pulsing of the helium through the solenoid valve 118 at a rate of about two to ten pulses per second with each pulse lasting a duration of about 0.001 to 1.0 second was found to optimize the signal from the air sample and thereby improve the sensitivity of the mass spectrometer about an order of magnitude relative to a fixed ratio, continuous mixing of helium and air. The pulsing of the helium to be mixed with the air sample can be conveniently controlled by using simple control dials such as shown at 126 and 128 with the dial 126 providing a delay between the pulses and the dial 128 providing for the duration of each pulse.

A pump 120 pulls the air sample from the location being monitored through the tubing 100 for delivery to the sample introducing apparatus 10. Since the volume of the air sample conveyed through the tubing 100 is significantly larger than that which can be discharged from the open/split interface or transported through the capillary 24, a substantial portion of the air-helium mixture is separated and removed from the sampling circuit. A flow volume reducing conduit 122 containing a flow control valve 124 couples the second tee 108, which is positioned intermediate to the helium adding tee 106 and the entrance to passageway 90 in the plug 88, to a pump 120 which draws a substantial portion of the helium-air mixture from the conduit segment 104 and discharges this mixture to atmosphere or which may be coupled to a remote sample storage site. By removing a substantial portion of the air-helium mixture before it is introduced into the open/split interface of the sample introducing apparatus 10, the capability for real-time monitoring is significantly enhanced since the time lapse from obtaining the air sample from a source remote to the sample preparing module 94 is relatively short and substantially quicker than if a smaller diameter tubing was used for obtaining the sample. The control valve 124 is utilized to control or regulate the volume of the helium-air mixture removed from the conduit segment 104. This decrease in the volume of the helium-air mixture provided at tee 108 enables the air stream to be continuously sampled at a high flow rate and significantly decreases the response time for the analysis of the sample by the mass spectrometer.

The air-sampling module 94 is also coupled to the conduit segment 70 of the open/split interface in the sample introducing apparatus 10 by tubing 132 which is used to extract a substantial portion of the remaining volume of the helium-air mixture from the open/split interface through a conduit 134 connected to the pump 120 via conduit 122 and flow control valve 135. By employing this connection between the pump 120 and the open/split interface, the dead volume in the sample introducing apparatus 10 can be substantially reduced so as to provide a response time for sample analysis by the mass spectrometer of only a few seconds after the air sample is introduced into the open end of the tubing 100.

Figure 3:
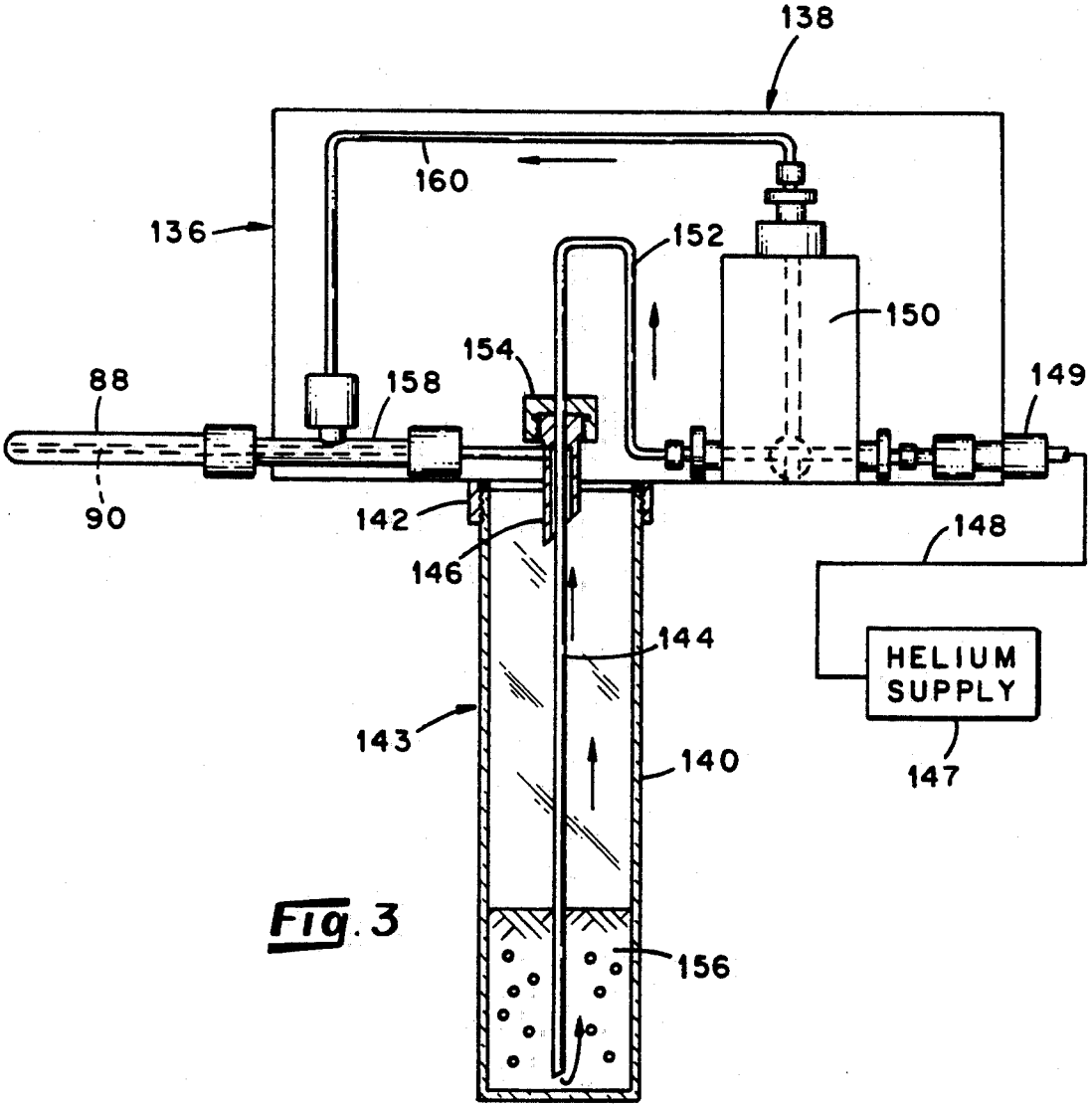
FIG. 3 is a vertical, partially sectional view of a soil/-water purge module which is readily coupled to the sample introducing apparatus of FIG. 1.

FIG. 3 illustrates a soil/water purge sample module 136 which is formed of a casing 138 cantileveredly supporting the probe 88 on a side surface thereof. A vial 140 containing water or soil with at least one volatile or partially volatile chemical therein is attached to the casing 138 through a suitable coupling such as a thread-type coupling 142. The casing 138 which is formed of stainless steel or another suitable metal is provided with a high speed needle sparge purging system 143 defined by a hollow needle 144 such as provided by a 0.0625 inch stainless steel tubing extending to a location near the base of the sample vial 140. This needle 144 extends through a hollow discharge needle 146 of stainless steel or the like that terminates near the base of the casing 138.

A helium supply 147 is attached by line 148 to a helium inlet 149 coupled to a three-way solenoid valve 150 which controls the flow of helium through two conduits in the module 136. The first of these two conduits is conduit 152 which connects the solenoid valve 150 through a suitable air-tight coupling 154 to the sample sparging needle 144. A helium flow rate in the range of about 100 to 200 mL/min can be satisfactorily introduced through the needle 144 for effectively purging the volatile and partially volatile chemicals from a sample of soil or liquid such as water as generally indicated at 156 in the vial 140. The gaseous sample purged from the soil or liquid 156 is entrained in the helium flowing therethrough. The resulting helium-sample mixture flows through the discharge needle 146 and then through conduit 158 which is directly coupled to passageway 90 in the probe 88. A further conduit 160 is connected between the solenoid valve 150 and the conduit 158 at a location downstream of the sample sparging system 143 for providing a stream of helium to the mass spectrometer 14 when the module 136 is not supplying a gaseous sample for analysis so as to assure that a continuous flow of helium is introduced into the mass spectrometer 14 for maintaining the viability thereof.

Figure 4:
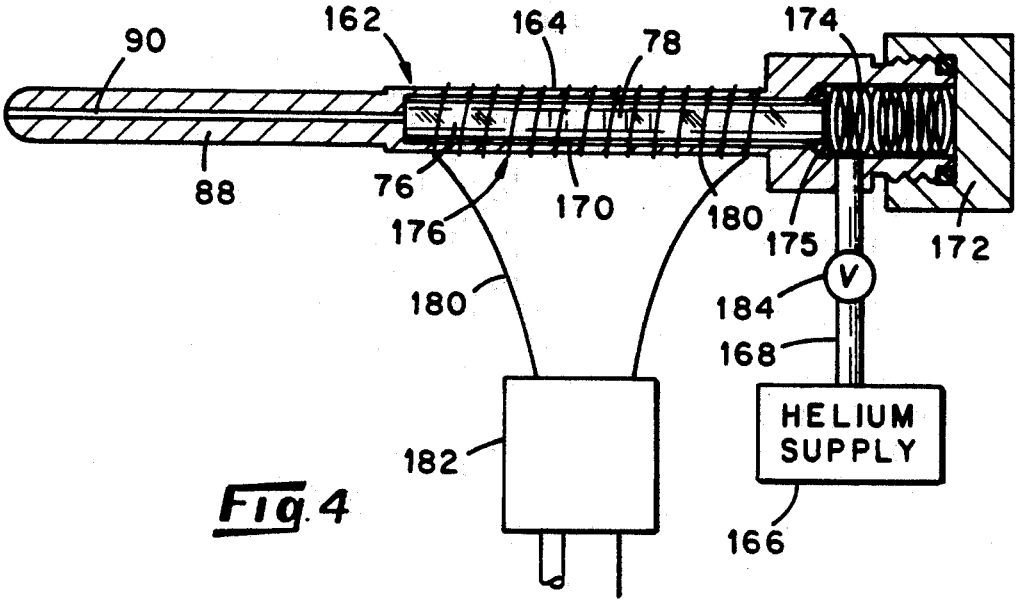
FIG. 4 is a vertical, partially sectional view of a thermal desorption module that is readily coupled to the sample introducing apparatus of FIG. 1.

As shown in FIG. 4, a thermal desorption module 162 is provided for desorbing a sample contained on a sorbent such as used in the archiving system 38. The thermal desorption module 162 is formed of an open-ended cylinder 164 having one end thereof attached to the probe 88 while a helium supply 166 is attached to the cylinder 164 near the opposite end thereof through conduit 168 which is connected to cavity 170 in the cylinder 164. The cavity 170 is of a dimension sufficient to contain a sample cartridge such as the cylinder 76 used in the archiving system 38. The sample-containing cylinder 76 is positioned within the cavity 170 through a removable end cap 172 provided with an O-ring or the like seal for providing an air-tight connection with the cylinder 164. A coiled compression spring 174 is placed between the end cap 172 and an end wall of the sample-containing cylinder 76 for compressing an O-ring seal 175 anound the sample containing cylinder 76 in the cavity 170 with respect to the thermal desorption heating mechanism 176. This heating mechanism 176 can be suitably provided by coating the outer surface of the module cylinder 164 with a layer (not shown) of high temperature cement such as "Omega CC" high-temperature cement and then securing a winding of high temperature resistance heater wire 180 of Nichrome or the like to the cement layer. An electrical plug 182 is used to connect the heater wire 180 to a suitable electrical outlet. A valve 184 in conduit 168 is utilized to control the flow of helium from the helium supply 166 into the desorber where flash desorption of the sorbent 78 contained within the cylinder 76 is accomplished by heating the sample-containing sorbent to a temperature in the range of about 175° to 300° C.

Figure 5:
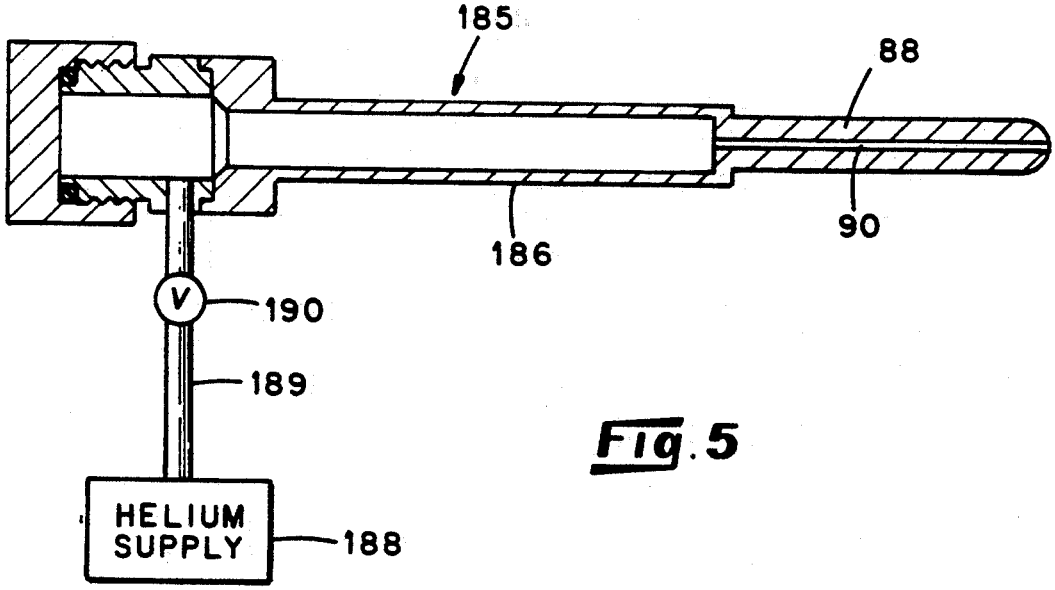
FIG. 5 is a vertical view illustrating a module which is interfaced with the sample introducing apparatus of FIG. 1 and used for bathing surfaces in the mass spectrometer with helium during periods of operation when direct analysis of samples is not being effected.

FIG. 5 is directed to a helium supplying module 185 which is used for providing the mass spectrometer 14 with a stream of helium for cooling and bathing the inner surfaces of the mass spectrometer when the mass spectrometer 14 is not analyzing samples provided by the above described modules. This helium supplying module 185 is provided by a conduit 186 connected to the probe 88 and a helium supply 188 through line 189 containing a suitable flow control valve 190. This module 185 is preferably attached to the sample introducing apparatus 10 when the other modules are not being employed.

It will be seen that the present invention provides for using a single mass spectrometer for performing several diverse types of analyses of gaseous samples through the capability of employing rapidly changeable sample preparing modules without shutting down the mass spectrometer for reconfiguration. The archiving of sample portions for subsequent reexamination of a sample provides an advantage not heretofore available. Also, while the sample preparing modules of FIGS. 2–4 are shown and described as being attached to a mass spectrometer through the sample introducing apparatus 10, it will appear clear that these modules can each be used for preparing samples for the introduction thereof into a gas chromatograph or a sorbent-containing cartridge for archival purposes.

What is claimed is:

1. An interface system for introducing a gaseous sample for analysis into a mass spectrometer provided with a housing having a vacuum region therein, comprising a sample introducing apparatus and a sample providing module means adapted to be connected thereto, said apparatus comprising an open-ended elongated tubular means supported by said housing and having a first end region contained within said housing and a second end region positioned external to said housing, sample module coupling means supported by said second end region, a single elongated capillary within the tubular means with a first end segment thereof in open communication with said coupling means and with a second end segment projecting from the open end of the first end region of the tubular means in open communication with the vacuum region within the housing, first conduit means containing at least a portion of said first end segment of the capillary and having one end thereof in open communication with said coupling means, clamping means supported by at least one of the tubular means and a second end of the first conduit means for providing an air-tight seal therewith about the capillary, said sample module means adapted to be operatively interfaced with said first conduit means through said coupling means for introducing into said first conduit means a gaseous stream containing a sample to be analyzed in the mass spectrometer via a minor portion of said gaseous stream being transported through the capillary for introduction into the vacuum region within the housing, and second conduit means having one end thereof extending substantially external to the tubular means and a second end thereof coupled to the first conduit means in open communication therewith for receiving therefrom a major portion of the gaseous stream introduced into said second conduit means by the sample module means and removing the received major portion of the gaseous stream from the tubular means whereby only said minor portion of the gaseous stream enters the capillary through said one end thereof for transport through the capillary.

2. An interface system for introducing a gaseous sample for analysis into a mass spectrometer as claimed in claim 1, wherein said coupling means comprises receptacle means or hollow plug means supported at said one end of the first conduit means, wherein connecting means are supported on said sample module means, and wherein said connecting means comprises hollow plug means or receptacle means adapted to be respectively coupled to the hollow receptacle means or the plug means of said coupling means, and module clamping means for securing the hollow plug means within the receptacle means and providing a substantially air-tight seal therebetween.

3. An interface system for introducing a gaseous sample for analysis into a mass spectrometer as claimed in claim 1, wherein open-ended cylindrical means containing sorbent means are attachable at one end thereof to said one end of the second conduit means for receiving the major portion of the gaseous stream transported therethrough and retaining on said sorbent means at least a portion of the sample contained in the major portion of the gaseous stream.

4. An interface system for introducing a gaseous sample for analysis into a mass spectrometer as claimed in claim 1, wherein the major portion of the gaseous stream consists of about 90 to about 99.9 percent of the gaseous stream introduced into the second conduit means by the sample module means.

5. An interface system for introducing a gaseous sample for analysis into a mass spectrometer as claimed in claim 1, wherein said sample module means is an air sampling module for analysis of a gaseous sample contained in air, wherein said air sampling module comprises casing means, connecting means supported by the casing means for removably attaching the casing means to said coupling means, first gas conveying means having one end in open communication with the connecting means and a second end adapted to receive a stream of sample-containing air, pump means for displacing the stream of air through the first gas conveying means, second gas conveying means coupled to said first gas conveying means at a location thereon adjacent to said one end for introducing a stream of an inert gas thereinto for mixture with the gaseous sample therein, and means operatively associated with the second gas conveying means for pulsing the stream of inert gas in the second gas conveying means prior to the mixture thereof with the gaseous sample in the first gas conveying means.

6. An interface system for introducing a gaseous sample for analysis into a mass spectrometer as claimed in claim 5, wherein third gas conveying means are connected to the said pump means and to the first gas conveying means at a location intermediate to the connecting means and the coupling with the second gas conveying means for removing a substantial portion of said mixture from the first gas conveying means.

7. An interface system for introducing a gaseous sample for analysis into a mass spectrometer as claimed in claim 6, wherein fourth gas conveying means are coupled to said one end of said second conduit means and said third gas conveying means for receiving the major portion of the gaseous stream received by the second conduit means.

8. an interface system for introducing a gaseous sample for analysis into a mass spectrometer as claimed in claim 5, wherein flow control means are operatively associated with the second, third and fourth gas conveying means for the controlling the flow of gas therethrough.

9. An interface system for introducing a gaseous sample for analysis into a mass spectrometer as claimed in claim 1, wherein said sample module means is a soil/liquid purge module for the analysis of gaseous samples sparged from soil or a liquid contained in a containment vessel, wherein said soil/liquid purge module comprises casing means, connecting means supported by the casing means for removably coupling the casing means to said coupling means, said containment vessel having an enclosed volume therein for containing a sample-containing soil or a sample-containing liquid and an end region having an opening therethrough in communication with the enclosed volume, attaching means supported by the casing means for receiving and retaining said end region of the containment vessel, concentric first and second hollow needle means supported by the casing means and projecting into the containment vessel through said opening with said first needle means being of a length sufficient to extend into a sample-containing soil or a sample-containing liquid within the enclosed volume of the containment vessel, first tube means having a first end region thereof coupled the second needle means and a second end region thereof coupled to said connecting means, and second tube means coupled to said first needle means for conveying a stream of inert gas therethrough to sparge and convey at least a portion of the sample from a sample-containing soil or a sample-containing liquid within the vessel into said second needle means for providing the sample introducing apparatus with said gaseous stream consisting essentially of the sparged portion of the sample and essentially all of the inert gas conveyed through said first needle means.

10. An interface system for introducing a gaseous sample for analysis into a mass spectrometer as claimed in claim 9, wherein valve means are operatively associated with the second tube means for controlling the flow of inert gas therethrough, wherein third tube means are coupled to said valve means and to said first tube means at a location adjacent to said connecting means, and wherein said valve means are adapted to selectively control the flow of inert gas through said second tube means or through said third tube means.

11. An interface system for introducing a gaseous sample for analysis into a mass spectrometer as claimed in claim 1, wherein said sample module means is a thermal desorption module for analysis of a sample contained by and desorbable from a sorbent bed disposed within a tubular housing, said thermal desorption module comprises an elongated cylinder having first and second end regions with said first end region of the cylinder having a passageway extending therethrough and coupled at one end thereof to said connecting means and with said second end region of the cylinder having a cavity therein for containing the tubular housing, conduit means coupled to the said second end region of said cylinder at a location adjacent to an end thereof spaced from said passageway for conveying a stream of an inert gas into the cavity, and heating means supported by the cylinder and adapted to heat the sorbent bed in the tubular housing to a temperature sufficient to desorb the sample from the sorbent bed for admixture with the stream of inert gas to provide the sample introducing apparatus with said gaseous stream through said passageway.

12. Apparatus for introducing a gaseous sample for analysis into a mass spectrometer provided with a housing having a vacuum region therein, comprising an open-ended elongated tubular means adapted to be supported by said housing with a first end region contained within said housing and with a second end region positioned external to said housing, sample module coupling means supported by said second end region of the tubular means and adapted to receive a gaseous stream containing the gaseous sample from sample supply means adapted to be connected to the coupling means, a single elongated capillary within and extending through the tubular means with a first end segment of the capillary being in open communication with said coupling means and with a second end segment of the capillary projecting from the open end of the first end region of the tubular means in communication with the vacuum region within the housing for conveying thereinto through said capillary a minor portion of the gaseous stream received in said coupling means, first conduit means containing at least a portion of said first end segment of the capillary and having a first and second ends with the first end of the first conduit means connected to and in open communication with said coupling means for receiving the gaseous stream therefrom, clamping means supported by at least one of the tubular means and the second end of the first conduit means for providing an air-tight seal about the capillary, and second conduit means having a first open end thereof positioned substantially external to the tubular means and a second open end thereof coupled to the first conduit means for receiving therefrom a major portion of the gaseous stream received from said coupling from the sample module means and discharging the received major portion of the gaseous stream from the tubular means through said first open end of the second conduit means.

13. Apparatus for introducing a sample for analysis into a mass spectrometer as claimed in claim 12, wherein said first conduit means is substantially concentric with and encompasses said at least a portion of the first end segment of said capillary, and wherein said second conduit means is disposed substantially perpendicular to said first conduit means.

14. Apparatus for introducing a sample for analysis into a mass spectrometer as claimed in claim 13, wherein open-ended cylindrical means containing sample sorbent means are attachable at one end thereof to the said first open end of the second conduit means for receiving the major portion of the gaseous stream received therein and retaining on said sorbent means at least a portion of the sample contained in the major portion of the gaseous stream.

15. Apparatus for introducing a sample for analysis into a mass spectrometer as claimed in claim 12, wherein elongated tube means extends from the first end region of the tubular means to a location adjacent to said second end of the first conduit means for containing a substantial length of the elongated capillary, wherein elongated heat conducting means are disposed about the elongated tube means over substantially the length thereof, and wherein heating means are operatively associated with the heat conducting means, the first conduit means and the coupling means for respectively heating said substantial length of the capillary and said first end segment thereof, the first and second conduit means, and the coupling means to a temperature adequate to inhibit adsorption of the gaseous sample on inner wall regions of the capillary, the first and second conduit means, and the coupling means.

16. Apparatus for introducing a sample for analysis into a mass spectrometer as claimed in claim 12, wherein the end of the first end region of the tubular means is substantially closed except for the opening therein through which the second end segment of the capillary extends, wherein said clamping means are supported by the tubular means at the closed end thereof for isolating the vacuum region of the housing from the interior of the tubular means except for communication with said first conduit means through the capillary.

17. Apparatus for introducing a sample for analysis into a mass spectrometer as claimed in claim 12, wherein the end of the first end region of the tubular means is substantially closed except for the opening therein through which the second end segment of the capillary extends, wherein said clamping means is provided by first and second clamping means, wherein the first clamping means are supported by the tubular means at the closed end thereof for isolating the vacuum region of the housing from the interior of the tubular means about the capillary, and wherein the second clamping means are supported by the second end of the first conduit means for isolating the interior of the first conduit means from the interior of the tubular means about the capillary.

18. Apparatus for introducing a sample for analysis into a mass spectrometer as claimed in claim 12, wherein the tubular means is of a length in the range of about 8 to 16 inches, and wherein the capillary is formed of fused silica, is of a length in the range of about 7 to 15 inches, and has a throughgoing bore of a size sufficient to provide a flow rate for the minor portion of the gaseous stream in the range of about 0.5 to about 1.0 m/L per minute.

19. Apparatus for introducing a sample for analysis into a mass spectrometer as claimed in claim 12, wherein the tubular means comprise a tubular section containing said first end region of the tubular means and end cap means removably attached to the tubular section and partially defining the second end region of the tubular means, wherein said end cap means supports the first and second conduit means, and wherein said coupling means are supported by and have an end region thereof extending through an end wall of the end cap means.

20. Apparatus for introducing a sample for analysis into a mass spectrometer as claimed in claim 14, wherein connector means are supported by said first open end of the second conduit means for attaching said one end of the cylindrical means to the second conduit means.

21. A module for preparing a gaseous sample of a chemical contained in air for analysis of the sample in a mass spectrometer with the module being connectable with sample receiving means, said module comprising casing means, connecting means having a passageway therethrough and supported by the casing means for removably attaching the casing means to the sample receiving means, first gas conveying means having one end in open communication with the connecting means and a second end adapted to receive a stream of sample-containing air, pump means for displacing the stream of air through the first gas conveying means, second gas conveying means coupled to said first gas conveying means at a location thereon adjacent to said one end for introducing a stream of an inert gas thereinto for mixture with the air therein, and means operatively associated with the second gas conveying means for pulsing the stream of inert gas in the second gas conveying means prior to the mixture thereof with the air in the first gas conveying means.

22. A module for preparing a gaseous sample of a chemical contained in air for analysis of the sample in a mass spectrometer as claimed in claim 21, wherein said connecting means comprises receptacle means or hollow plug means supported at said one end of the first gas conveying means and adapted to be coupled to hollow receptacle means or plug means supported by the sample receiving means, and wherein module clamping means are operatively associated with said connecting means for securing the module to the sample receiving means in a substantially air-tight manner.

23. A module for preparing a gaseous sample of a chemical contained in air for analysis of the sample in a mass spectrometer as claimed in claim 21, wherein third gas conveying means are coupled to said pumping means and to said first gas conveying means at a location intermediate the coupling with the second gas conveying means and said connecting means for removing a substantial portion of the mixture from the first gas conveying means prior to the mixture being received by the passageway in the connecting means.

24. A module for preparing a gaseous sample of a chemical contained in air for analysis of the sample in a mass spectrometer as claimed in claim 23, wherein the sample receiving means comprises interface means adapted to receive and transport a portion of the mixture from the module to the mass spectrometer, wherein fourth gas conveying means are connected to said pump means and are adapted to be operatively associated with the interface means for removing therefrom a substantial portion of the mixture received therein through the passageway in the connecting means and wherein flow control means are operatively associated with the fourth gas conveying means for controlling the volume of the mixture removed from the interface means.

25. A module for preparing a gaseous sample of a chemical contained in air for analysis of the sample in a mass spectrometer as claimed in claim 23, wherein flow control means are operatively associated with the second and third gas conveying means for respectively controlling the flow of the inert gas and the inert gas-sample mixture therethrough.

26. A thermal desorption module for preparing a sample of a chemical contained by and desorbable from a sorbent bed disposed within a tubular housing for analysis in a mass spectrometer with the module being connectable to sample receiving means, said module comprising an elongated cylinder having first and second end regions with said first end region having a passageway extending therethrough with an end of said passageway in communication with a cavity provided in the second end region for receiving the tubular housing containing the sorbent bed, connecting means supported by the cylinder at said first end region for removably attaching the cylinder to said sample receiving means, conduit means coupled to the cylinder at a location in said second region adjacent to an end thereof remote to said end of the passageway for conveying a stream of an inert gas into the cavity, and heating means supported by the cylinder and adapted to heat the sorbent bed to a temperature sufficient to desorb the sample from the sorbent bed in the tubular housing for admixture with the stream of inert gas to provide the sample receiving means with a stream of the gaseous mixture through said passageway.

27. A thermal desorption module for preparing a sample of a compound contained by and desorbable from a sorbent bed disposed within a tubular housing for analysis in a mass spectrometer as claimed in claim 26, wherein said connecting means comprises receptacle means or hollow plug means supported at said first end region of the elongated cylinder and adapted to be coupled to hollow receptacle means or plug means supported by the sample receiving means, and wherein module clamping means are operatively associated with said connecting means for securing the module to the sample receiving means in a substantially air-tight manner.

* * * * *